US011134827B2

(12) United States Patent
Yoon et al.

(10) Patent No.: US 11,134,827 B2
(45) Date of Patent: Oct. 5, 2021

(54) DISHWASHER

(71) Applicant: LG Electronics Inc., Seoul (KR)

(72) Inventors: Sangheon Yoon, Seoul (KR); Daegyu Kim, Seoul (KR)

(73) Assignee: LG Electronics Inc., Seoul (KR)

( * ) Notice: Subject to any disclaimer, the term of this patent is extended or adjusted under 35 U.S.C. 154(b) by 166 days.

(21) Appl. No.: 16/271,430

(22) Filed: Feb. 8, 2019

(65) Prior Publication Data

US 2019/0246871 A1 Aug. 15, 2019

(30) Foreign Application Priority Data

Feb. 9, 2018 (KR) ..... 10-2018-0016513

(51) Int. Cl.
*A47L 15/48* (2006.01)

(52) U.S. Cl.
CPC ..... *A47L 15/483* (2013.01); *A47L 15/486* (2013.01); *A47L 15/488* (2013.01); *A47L 2501/10* (2013.01); *A47L 2501/11* (2013.01); *A47L 2501/12* (2013.01)

(58) Field of Classification Search
CPC .... A47L 15/483; A47L 15/486; A47L 15/488; A47L 2501/10; A47L 2501/11; A47L 2501/12
USPC ..... 134/58 D
See application file for complete search history.

(56) References Cited

U.S. PATENT DOCUMENTS

2008/0072935 A1* 3/2008 Han ..... A47L 15/486 134/104.2
2013/0152967 A1 6/2013 Bertsch et al.

FOREIGN PATENT DOCUMENTS

| | | |
|---|---|---|
| CH | 693494 | 9/2003 |
| CN | 105147219 | 12/2015 |
| CN | 106264409 | 1/2017 |
| DE | 29621351 | 2/1997 |
| EP | 3257425 | 12/2017 |
| GB | 2263969 | 8/1993 |

OTHER PUBLICATIONS

Extended European Search Report in European Application No. 19156108.3, dated Jul. 11, 2019, 8 pages.

* cited by examiner

*Primary Examiner* — Tinsae B Ayalew
(74) *Attorney, Agent, or Firm* — Fish & Richardson P.C.

(57) ABSTRACT

A dishwasher includes: a cabinet defining an external appearance of the dishwasher; a tub disposed in the cabinet to form a space where to wash dishes; a heat exchanger disposed between the tub and the cabinet to form a space in which external air flows; and a condensing module disposed between the heat exchanger and the cabinet and configured to exchange heat of air discharged from the tub with the external air flowing in the heat exchanger such that the heat-exchanged air flows into the tub.

20 Claims, 9 Drawing Sheets

DISHWASHER

CROSS-REFERENCE TO RELATED APPLICATION

This application claims the priority benefit of Korean Patent Application No. 10-2018-0016513, filed on Feb. 9, 2018 in the Korean Intellectual Property Office, the disclosure of which is incorporated herein by reference.

FIELD

The present disclosure relates to a dishwasher and, more particularly, to a dishwasher which circulates air in a tub, condenses and heats the air during a circulating operation, thereby drying dishes in the tub.

BACKGROUND

A dishwasher is an apparatus that washes dishes using water and detergent through washing, rinsing, and drying courses in a space where the dishes are held. With the washing and rinsing courses using water and detergent, food remains or other foreign substances can be removed from the dishes. In addition, the dishes can be completely washed with the drying course in which moisture remaining in the dishes are removed.

The drying course of the dishwasher may consist of a step of increasing temperature of water to be sprayed toward dishes such that temperature of the dishes increases to facilitate evaporation of moisture on the dishes, and a step of removing the evaporated moisture by condensing the moisture in a cooling duct provided inside or outside of a wash tank or by making the moisture to be absorbed by an absorbent.

In the case of discharging humid air in a tub to the outside, it is possible to quickly dry dishes in the dishwasher but this may lead to mold to grow around the dishwasher due to a great amount of discharged humid air or damage outer components of the dishwasher.

In order to enhance performance of drying the inside of the tub, an additional condensing flow path may be formed to discharge humid air from the tub. However, condensing humid vapor discharged from the tub simply by forming a flow path may result in degradation of condensing performance.

In addition, if humid air not properly condensed is discharged to the outside, it may cause a possibility to damage the surroundings of the dishwasher.

Korean Patent Application No. 10-2015-0168759 discloses an air blower provided on the top of a tub, the air blower which spray out air jet. Since the air blower opens a door to discharge humid vapor and the air get from the tub, and there is a problem that an excessive amount of humid vapor may be discharged from the tub.

SUMMARY

One object of the present disclosure is to provide a dishwasher that processes humid air in a tub, thereby drying the inside of the tub efficiently.

Another object of the present disclosure is to provide a dishwasher that does not discharge humid vapor to the outside of the dishwasher while processing humid air in a tub to dry the inside of the tub.

Yet another object of the present disclosure is to provide a dishwasher that removes some of humid vapor in a tub while processing humid air in the tub to dry the inside of the tub.

Yet another object of the present disclosure is to provide a dishwasher having a structure which enables processing condensed water generated when humid air in a tub is processed to dry the inside of the tub.

The technical objects of the present disclosure are not limited to the aforementioned objects, and other unmentioned objects will be apparent to a person having ordinary skill in the art from the following description.

In order to achieve the above and other objects, an embodiment of the present disclosure provides a dishwasher, including: a cabinet defining an external appearance of the dishwasher; a tub disposed in the cabinet to form a space where to wash dishes; a heat exchanger disposed between the tub and the cabinet to form a space in which external air flows; and a condensing module disposed between the heat exchanger and the cabinet and configured to exchange heat of air discharged from the tub with the external air flowing in the heat exchanger such that the heat-exchanged air flows into the tub.

The dishwasher may further include a heating module configured to heat the air having passed through the condensing module and supply the heated air to an inside of the tub.

The heating module may include: a heater configured to heat the flowing air; and a hot air tube configured to deliver the air heated by the heater to the inside of the tub. Accordingly, the condensed air may be heated by the heater and supplied to the tub through the hot air tub.

The hot air tube may include: an ascending flow path, along which air ascends, and a descending flow path, along which the air flown from the ascending flow path descends to be supplied to the tub, are formed in the hot air tube, and the heater may be disposed below the ascending flow path. Accordingly, wash water sprayed in the tub may be prevented from flowing into the tub.

The dishwasher may further include a circulating fan module configured to enable air in the tub to pass through the condensing module and then flow back into the tub. Accordingly, the air in the tub may circulate.

The condensing module may include: a condensing chamber disposed between the cabinet and the heat exchanger to form a space in which air discharged from the tub flows; and a condensing chamber connecting pipe disposed on the tub to connect an inside of the tub and the condensing chamber. Accordingly, hot humid vapor discharged from the top of the tub may be delivered to the condensing chamber through the condensing chamber connecting pipe.

The condensing chamber may is disposed to contact the heat exchanger, in which external air flows, through one side surface of the condensing chamber and contact the cabinet through the other side surface of the condensing chamber. Accordingly, the condensing chamber may condense air by performing heat exchange with the heat exchanger and the cabinet through both side surfaces.

A flow path guide, which guides air flowing in the condensing chamber, may be formed in the condensing chamber, a condensed water guide, which guides movement of condensed water generated in the condensing chamber, may be formed in the condensing chamber, and the condensed water guide may be disposed below the flow path guide. Accordingly, condensed water generated from air having passed through the flow path guide may flow along the condensed water guide.

A condensed water discharge hole, which is disposed below the condensed water guide such that the condensed water generated in the condensing chamber is discharged to an inside of the tub, may be formed in the tub, and a condensed water discharge guide, which guides condensed water flowing along the condensed water guide to the condensed water discharge hole, may be formed in the tub. Accordingly, the condensed water generated in the condensing module may be supplied to the inside of the tub.

A circulator inflow hole may be formed on an upper surface of the tub such that air in the tub flows into the condensing module, a circulator exhaust hole may be formed on a side surface of the tub such that air flowing in the condensing module flows to the inside of the tub, and the condensed water discharge guide may guide the condensed water generated in the condensing chamber to the circulator exhaust hole. Accordingly, the condensed water generated in the condensing module may be supplied to the inside of the tub.

The dishwasher may further include a condensing chamber connecting pipe which is connected to the circulator inflow hole, formed on the upper surface of the tub, to deliver air in the tub to the condensing module, and the condensing chamber connecting pipe may have a sloped surface at a portion extending upward from the circulator inflow hole, the sloped surface whose area increases upward. Accordingly, wash water sprayed in the tub may be prevented from being flowing into the condensing module through the condensing chamber connecting pipe.

The heat exchanger may include: a heat exchanger disposed between the condensing module and the tub to form a space in which external air flows; an external air inflow part disposed in front of the heat exchange chamber, and having an external air inflow part formed at a front of the external air inflow part; and an external air discharge part configured to operate an exhaust fan disposed therein, such that external air flowing in the heat exchange chamber is discharged to an outside of the cabinet. Accordingly, the external air may be introduced from the front, pass through the heat exchanger, and be than discharged to an outside.

The external air inflow hole may be formed in a front lower portion of the external air inflow part. Accordingly, cold air may be introduced from a lower side to be supplied to an upper side.

A heat exchange chamber-flow path guide, which guides external air introduced from a front in a rearward and upward direction, may be formed in the heat exchange chamber.

Accordingly, the external air may flow in a wider area inside the heat exchanger.

An embodiment of the present disclosure provides dishwasher including: a cabinet defining an external appearance of the dishwasher; a tub disposed in the cabinet to form a space where to wash dishes; a heat exchanger disposed between the tub and the cabinet and forming a space in which air introduced from an outside flows; and a circulator disposed on one side of the heat exchanger to condense air, which is discharged from the tub, through heat exchange with the heat exchanger, heat the air using a heater, and supply the heated air into the tub. Accordingly, air in the tub may circulate and be condensed through heat exchange with external air during the circulation, thereby drying dishes placed in the tub.

The details of other embodiments are included in the following description and the accompanying drawings.

The dishwasher of the present disclosure has one or more effects as below.

First, since a heat exchanger in which external air flows is disposed between a tub and a condensing module in which humid vapor discharged from the tub flows, circulating air discharged from the tub may be effectively condensed, thereby drying the inside of the tub more quickly. In addition, since the condensing module is disposed between a cabinet and the heat exchanger in which external air flows, the condensing module is capable of exchanging heat with external air on both side surfaces, so that air circulating in the tub is condensed actively.

Second, in a heat exchange process in which air is introduced from the outside and then discharged back to the outside, the air is maintained dry despite a change in temperature, so that humid air is not discharged to the outside of the dishwasher.

Third, a tub is disposed on one side surface of the heat exchanger in which external air flows, and thus, the heat exchanger is capable of condensing humid air in the tub, thereby effectively drying the inside of the tub. Specifically, it is advantageous that there is no additional thermal source used for condensation and that external air is used.

Fourth, water condensed in the condensing module is controlled to flow into the tub to thereby prevent the water from remaining in the condensing module, so that the inside of the condensing module may be kept clean.

Effects of the present disclosure should not be limited to the aforementioned effects and other unmentioned effects will be clearly understood by those skilled in the art from the claims.

BRIEF DESCRIPTION OF THE DRAWINGS

The embodiments will be described in detail with reference to the following drawings in which like reference numerals refer to like elements wherein.

DETAILED DESCRIPTION

Figure 1:
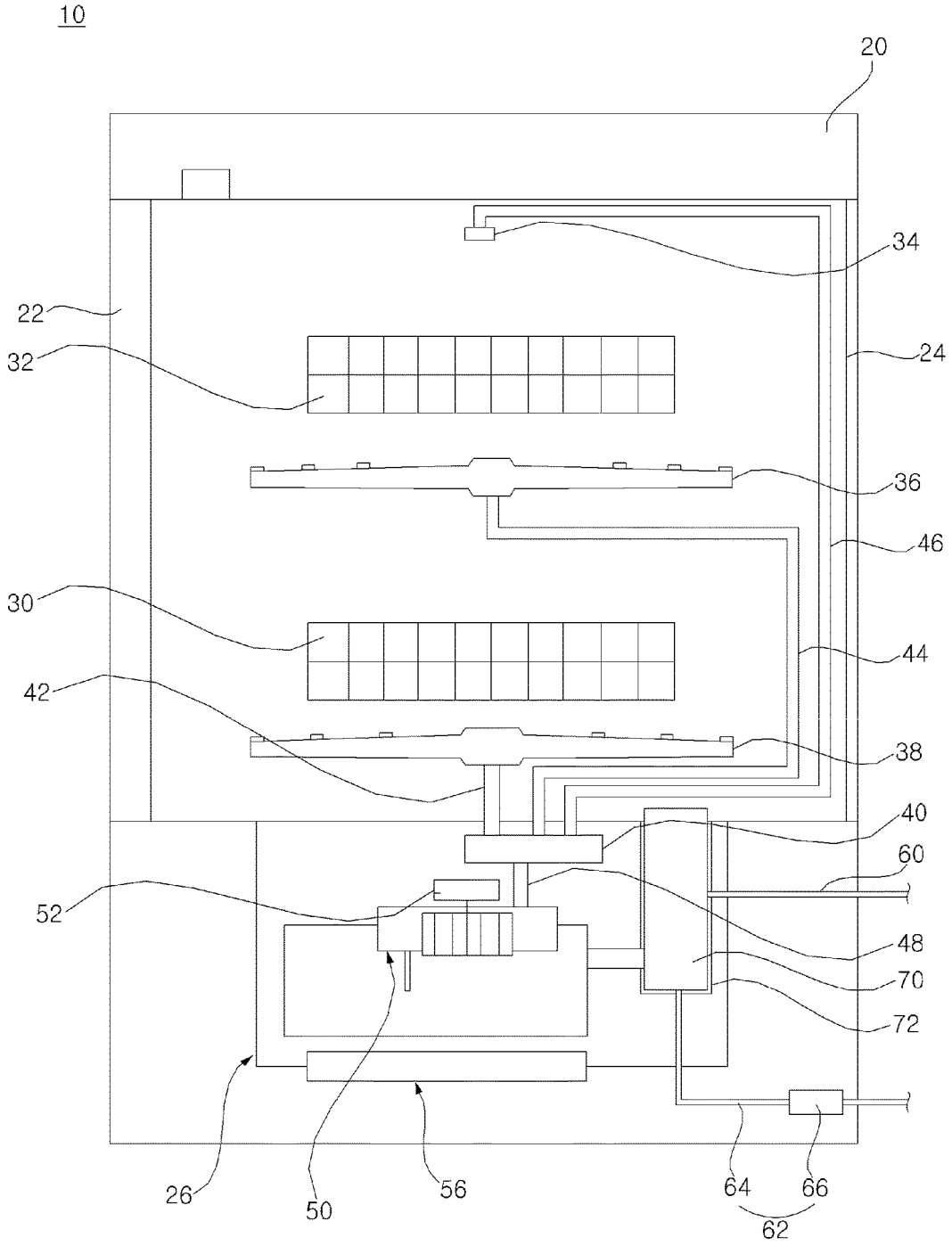
FIG. 1 is a schematic front cross-sectional view of a dishwasher according to an embodiment of the present disclosure.

Advantages and features of the present disclosure and a method of achieving the same will be clearly understood from embodiments described below in detail with reference to the accompanying drawings. However, the present disclosure is not limited to the following embodiments and may be implemented in various different forms. The embodiments are provided merely for complete disclosure of the present disclosure and to fully convey the scope of the disclosure to those of ordinary skill in the art to which the present disclosure pertains. The present disclosure is defined only by the scope of the claims. In the drawings, the thickness of layers and regions may be exaggerated for clarity. Throughout the drawings, like numbers refer to like elements.

Hereinafter, a dishwasher according to embodiments of the present disclosure will be described with reference to the accompanying drawings.

<Component of Dishwasher>

FIG. 1 is a schematic front cross-sectional view of a dishwasher according to an embodiment of the present disclosure.

Referring to FIG. 1, a dishwasher 10 according to the present embodiment includes a cabinet 20 defining an external appearance of the dishwasher 10, a door 22 coupled to the cabinet 20 to open and close the inside of the cabinet 20, and a tub 24 installed in the cabinet 20 to handle dishes positioned in the tub 24. The cabinet 20 and the tub 24 are in a structure having an opened front surface on which the door 22 is disposed.

The dishwasher 10 according to the present embodiment may include a dispenser (not shown) for storing detergent introduced by a user and introducing the detergent into the tub 24 in a washing step. The dispenser may be disposed in the door 22.

The cabinet 20 according to the present embodiment may define an external appearance of the dishwasher 10, and one side of the cabinet 20 may be opened. An external air inlet 222 through which air is introduced into an external air inflow part 220 may be formed on one side of the cabinet 20 according to the present embodiment. In addition, an external air outflow port (not shown) through which heat-exchanged external air is exhausted may be formed on the other side of the cabinet 20.

In order to wash dishes, the tub 24 forms a space where the dishes are to be placed. The tub 24 according to the present embodiment may have an air guide hole (not shown) on one side thereof to discharge air to the outside when pressure in the tub increase, thereby reducing the pressure.

The tub 24 according to the present embodiment is disposed inside the cabinet 20. With the cabinet 20, the tub according to the present embodiment may form a space where a heat exchange chamber 210 and a condensing chamber 112 are disposed. A circulator inflow hole 80, through which air is discharged from the tub 24 to a circulator 100, is formed on an upper surface of the tub 24 according to the present embodiment. A circulator exhaust hole 82, through which air flowing in the circulator 100 is discharged to the inside of the tub 24, is formed on a side surface of the tub 24 according to the present embodiment.

The dishwasher 10 according to the present embodiment includes: a rack 30 and 32 for accommodating dishes in the tub 24, a spray module for spraying wash water toward dishes accommodated in the rack 30 and 32; a sump 26 for supplying the wash water to the spray module; and a wash pump 50 for pumping the wash water stored in the sump 26.

The spray module serves to spray wash water toward dishes. The spray module includes: a spray nozzle 34, 36, and 38; and a supply pipe 42, 44, and 46 which connects the wash pump 50 and the spray nozzle 34, 36, and 38.

The dishwasher 10 further includes a wash motor 52 which drives the wash pump 50, and the wash motor 52 may be implemented as a Brushless Direct Current (BLDC) motor of which the number of rotations is controllable. Since the wash motor 52 is a BLDC motor, it is possible to set a target revolution per minute (RPM). If the rpm of the BLDC motor changes, a transfer force of the wash pump 50 changes.

The dishwasher 10 according to the present embodiment may further include: a water supply module 60 for supplying water to the sump 26 or the spray module; a drain module 62 connected to the sump 26 to discharge wash water to the outside; a filter module 70 installed in the sump 26 to filter the wash water; and a wash water heating module 56 installed in the sump 26 to heat the wash water.

The rack 30 and 32 for accommodating subjects to wash, such as dishes, are provided in the tub 24. The dishwasher 10 according to the present embodiment may include at least one rack 30 and 32. The rack 30 and 32 according to the present embodiment includes a lower rack 32 disposed in a low side of the tub 24, and an upper rack 30 disposed above the lower rack 32.

The dishwasher 10 according to the present embodiment may include at least one spray nozzles 34, 36, and 38. The dishwasher 10 according to the present embodiment includes: a lower nozzle 38 disposed in the tub 24 to wash a subject to wash accommodated in the lower rack 32; an upper nozzle 36 for washing a subject to wash accommodated in the upper rack 30; and a top nozzle 34 disposed in the highest point on the tub 24 to spray wash water.

The supply pipe 42, 44, and 46 according to the present embodiment connects the sump 26 and the spray nozzle 34, 36, and 38. If the wash pump 50 operates to pump wash water stored in the sump 26, the wash water is supplied to the spray nozzle 34, 36, and 38. The supply pipe 42, 44, and 46 according to the present embodiment includes: a first pipe 42 through which wash water is supplied to the lower nozzle 38; a second pipe 44 through which wash water is supplied to the upper nozzle 36; and a third pipe 46 through which wash water is supplied to the top nozzle 34.

The dishwasher 10 according to the present embodiment includes a flow path switching part 40 for supplying wash water stored in the sump 26 to the first pipe 42, the second pipe 44, and the third pipe 46.

The flow path switching part 40 according to the present embodiment includes a flow path switching motor (not shown) which generates a rotational force, and a rotary plate which rotates by the flow path switching motor to adjust a flow of wash water. The rotary plate according to the present embodiment may selectively open and close a plurality of connection holes (not shown) formed at a point where the plurality of supply pipes 42, 44, and 46 is branched. A plurality of switch holes (not shown) may be formed on the rotary plate. The rotary plate rotates in phases by the flow path switching motor. If the rotary plate rotates by the flow path switching motor, wash water pumped by the wash pump 50 may be sprayed toward at least one of the plurality of spray nozzles 34, 36, and 38 as the plurality of switch holes formed on the rotary plate is disposed at a position corresponding to at least one of a plurality of connection holes.

Wash water discharged from the sump 26 through the wash pump 50 moves to the flow path switching part 40 through a pump pipe 48. The flow path switching part 40 may supply wash water, introduced from the sump 26, to at least one of the first pipe 42, the second pipe 44, and the third pipe 46.

The upper nozzle 36 may be disposed below the upper rack 30. It is preferable that the upper nozzle 36 is rotatably coupled to the second pipe 44 so that the upper nozzle 36 rotates by a repulsive force of wash water when the wash water is sprayed from the upper nozzle 36.

The top nozzle 34 is disposed at a position higher than that of the upper rack 30. The top nozzle 34 is disposed in an upper side of the tub 24. The top nozzle 34 is supplied with wash water from the third pipe 45, and sprays the wash water toward the upper rack 30 and the lower rack 32.

The water supply module 60 is configured to be supplied with water from the outside and supply the water to the sump 26. In the present embodiment, the water supply module 60 is configured to supply water through the filter module 70 to the sump 26. The drain module 62 is configured to discharge wash water stored in the sump 26 to the outside, and the drain module 62 includes a drain pipe 64 and a drain pump 66.

The filter module 70 serves to filter out foreign substances, such as food remains, contained in wash water. The filter module is dispose on a flow path through which the wash water is introduced from the tub 24 and the sump 26.

To this end, a filter mounting part 72 into which the filter module 70 is installed may be formed in the sump 26, and a filter flow path for connecting the filter mounting part 72 and the sump 26 may be disposed in the sump 26.

The dishwasher 10 according to the present embodiment may include a water level sensing part which senses the level of water in the tub 24. The water level sensing part according to the present embodiment may include a floater (not shown) which detects the level of water in the tub 24, and a water level sensor (not shown) which senses a height of the floater to sense a water level.

The dishwasher 10 according to the present embodiment may further include: an input unit (not shown) which receives a command from a user; and a display unit (not shown) which displays a progress status of the dishwasher 10 or a notification to a user. The input unit may utilizes a touch input or a button input, and the display unit may use a display, a warning lamp, or the like.

Figure 2:
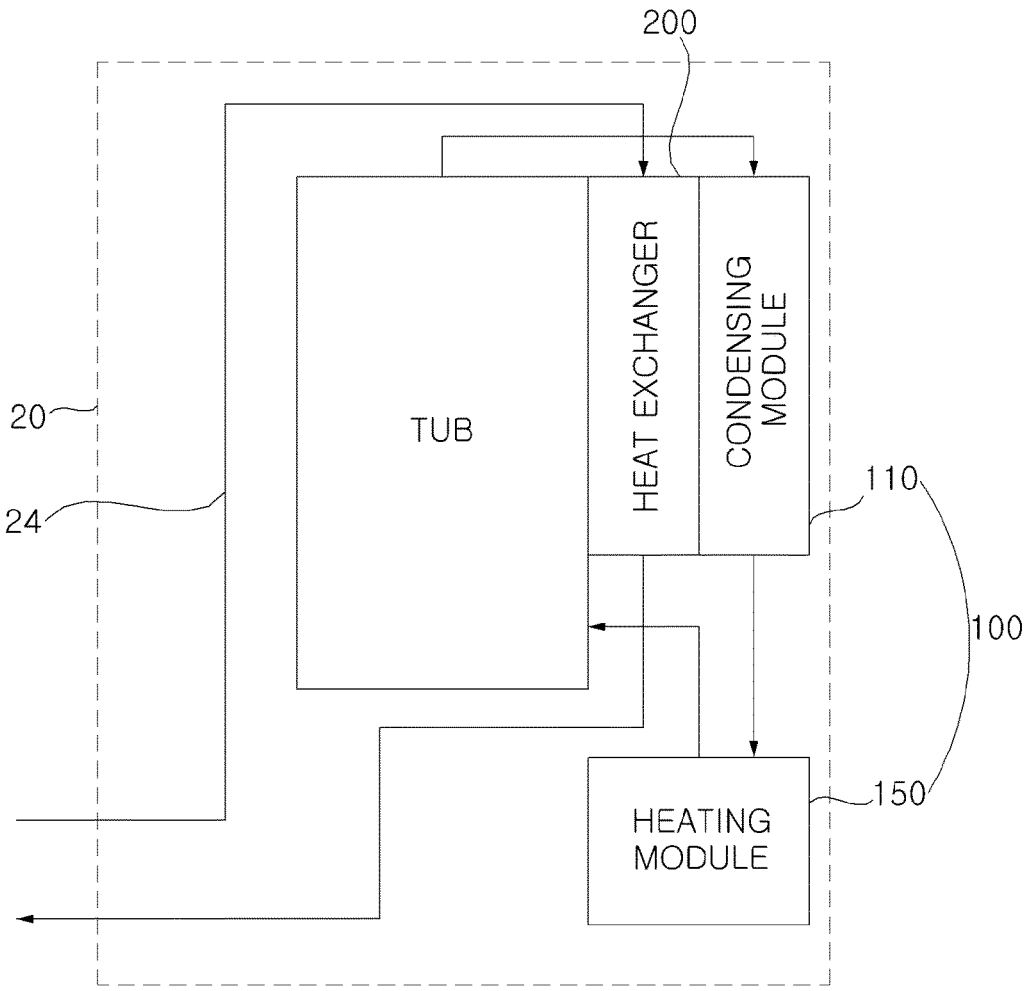
FIG. 2 is a schematic view for explanation of a relationship between a tub, a heat exchanger, and a circulator in a cabinet according to an embodiment of the present disclosure.
Figure 3:
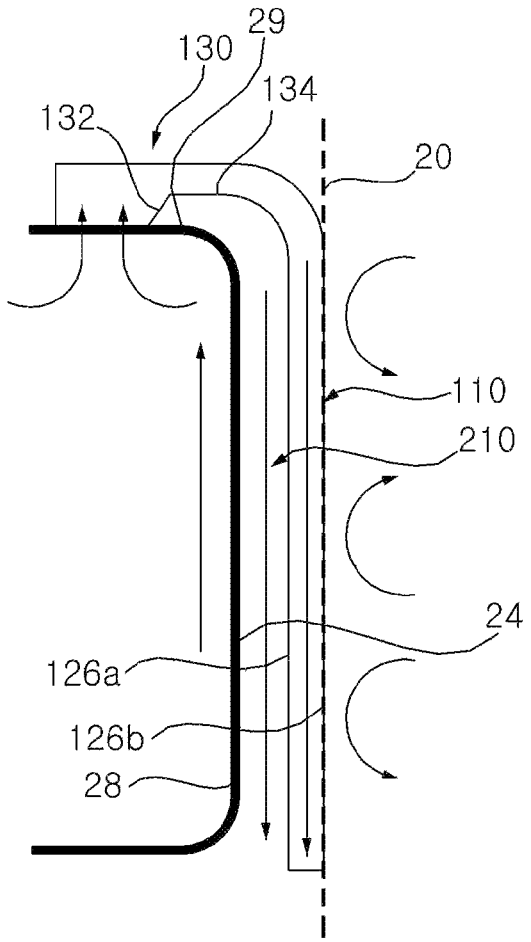
FIG. 3 is a schematic view for explanation of a relationship between a tub, a condensing chamber, and a heat exchanging chamber according to an embodiment of the present disclosure.
Figure 4:
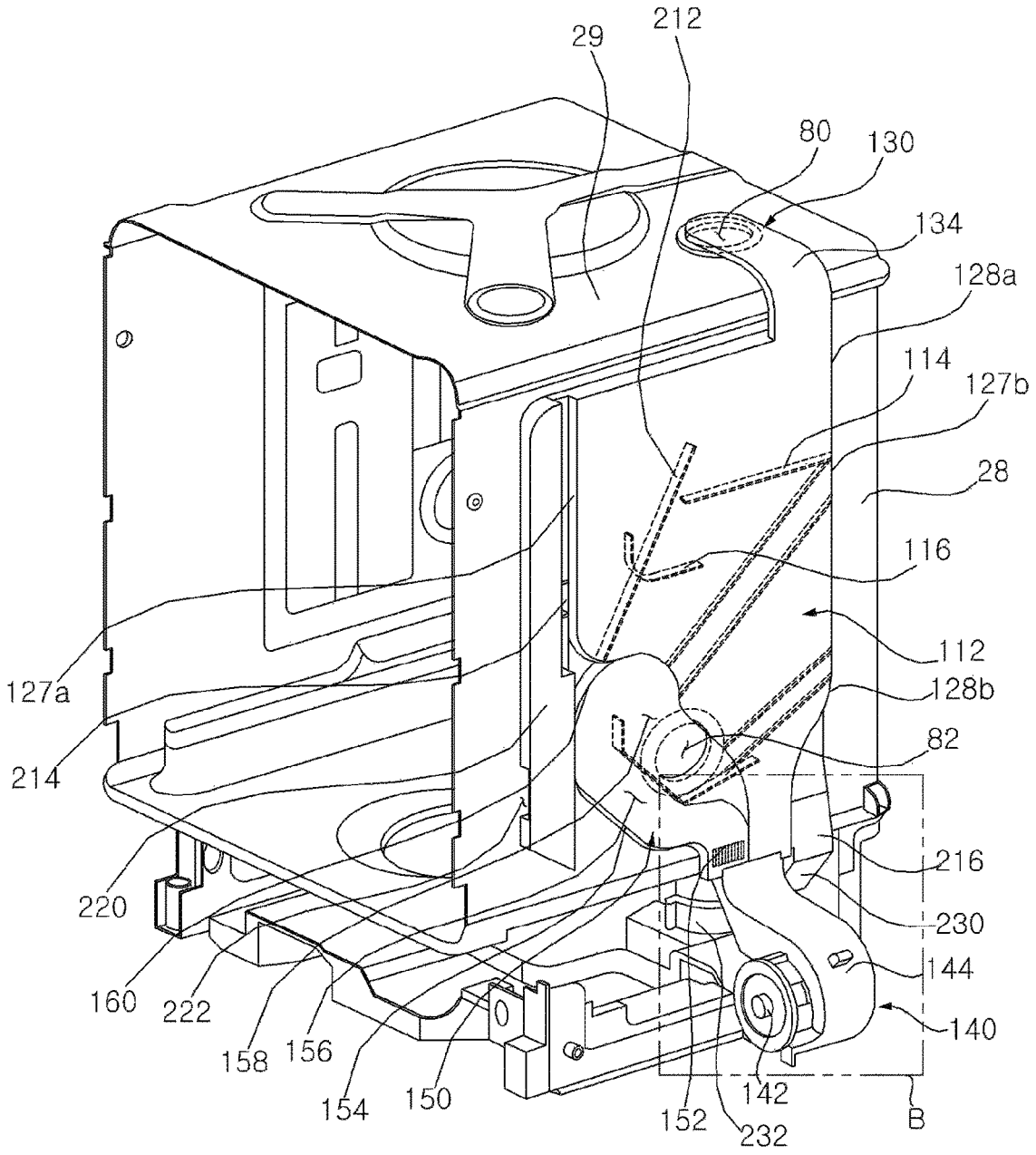
FIG. 4 illustrates a perspective view illustrating a circulator, a heat exchanger, and a tub according to an embodiment of the present disclosure.
Figure 5:
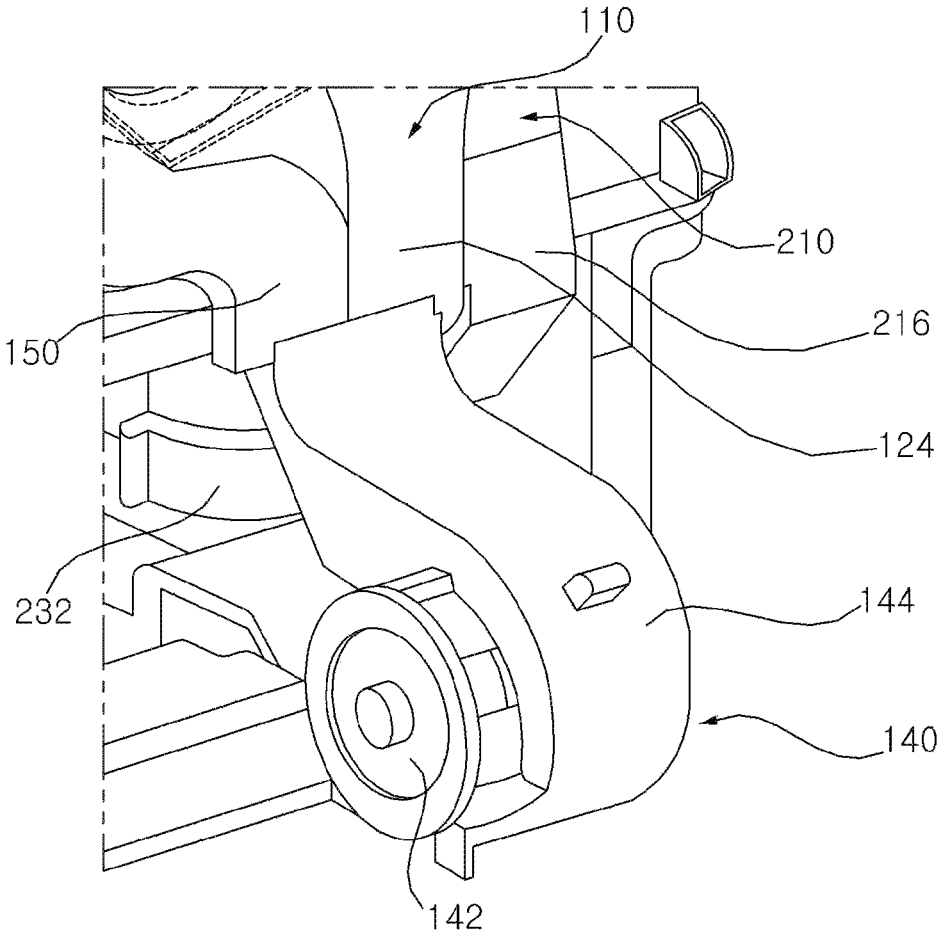
FIG. 5 is a detailed view of a portion B shown in FIG. 4.
Figure 6:
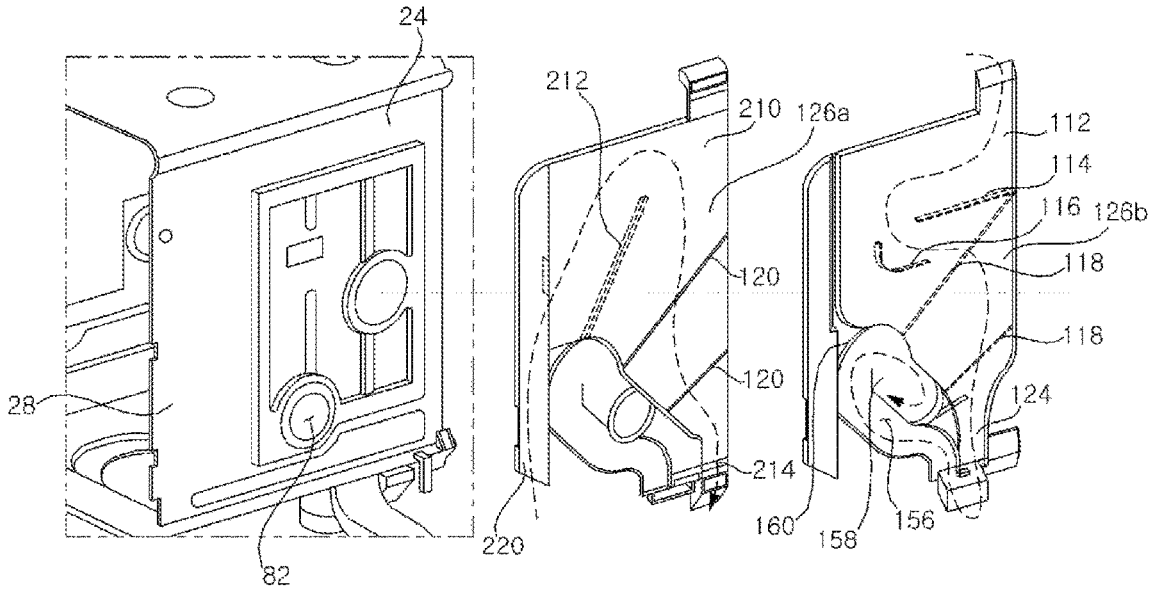
FIG. 6 is a diagram for explanation of a configuration, which forms a heat exchanging chamber and a condensing chamber, according to an embodiment of the present disclosure.
Figure 7:
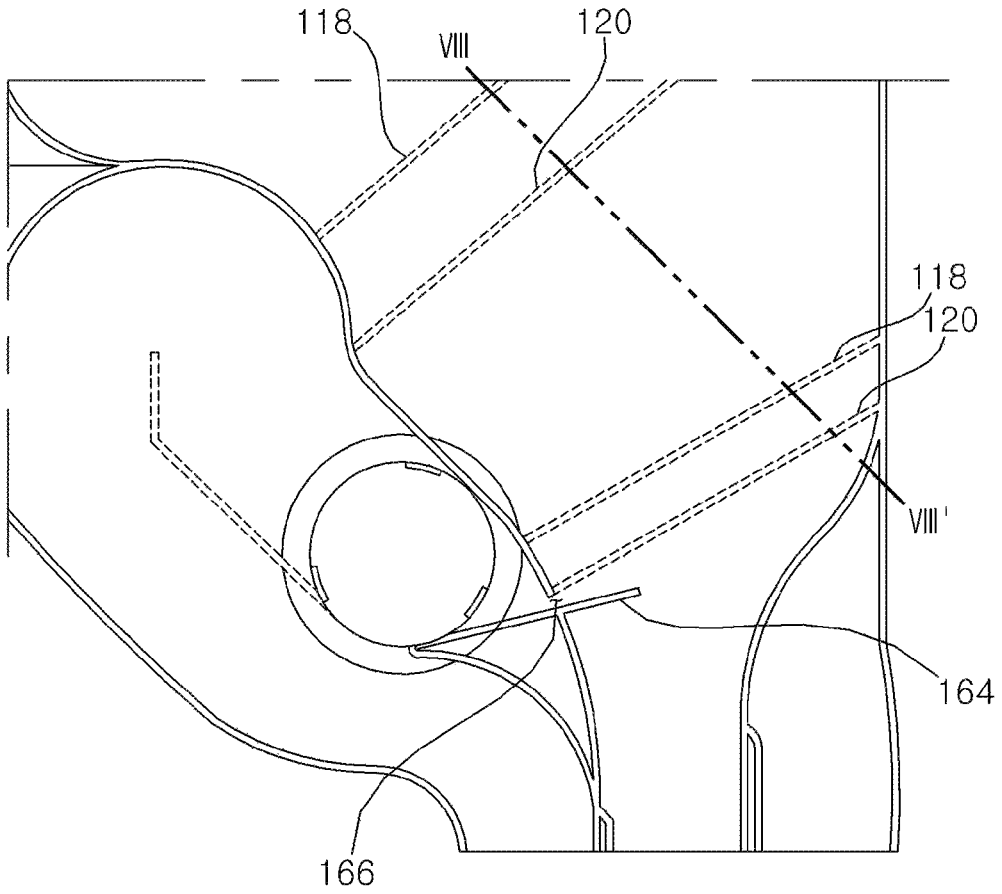
FIG. 7 is a diagram for explanation of a different portion of a condensing chamber and a structure of a heating module according to an embodiment of the present disclosure.
Figure 8:
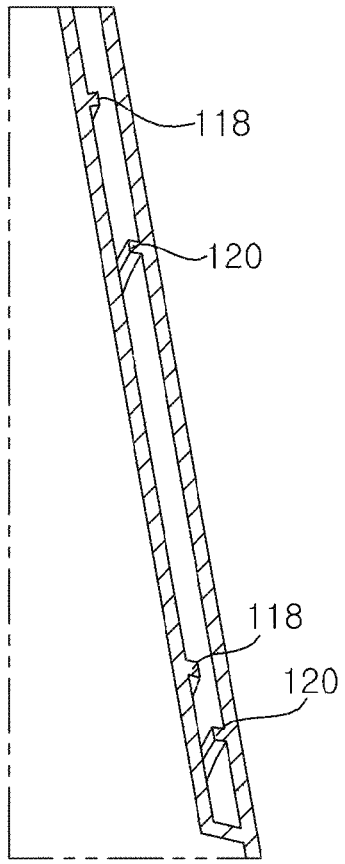
FIG. 8 is a perspective view of a cross-section cut along line VIII-VIII' shown in FIG. 7.
Figure 9:
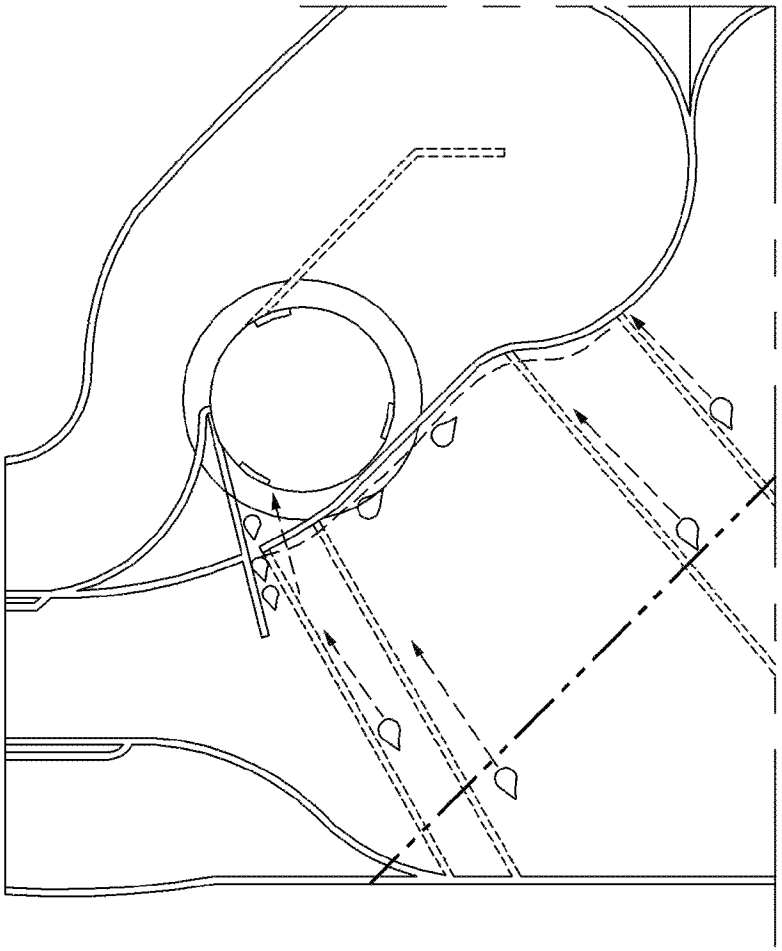
FIG. 9 is a diagram illustrating a flow of condensed water in the structure shown in FIG. 7.

FIG. 2 is a schematic view for explanation of a relationship between a tub, a heat exchanger, and a circulator in a cabinet according to an embodiment of the present disclosure. FIG. 3 is a schematic view for explanation of a relationship between a tub, a condensing chamber, and a heat exchanging chamber according to an embodiment of the present disclosure. FIG. 4 illustrates a perspective view illustrating a circulator, a heat exchanger, and a tub according to an embodiment of the present disclosure. FIG. 5 is a detailed view of a portion B shown in FIG. 4. FIG. 6 is a diagram for explanation of a configuration, which forms a heat exchanging chamber and a condensing chamber, according to an embodiment of the present disclosure. FIG. 7 is a diagram for explanation of a different portion of a condensing chamber and a structure of a heating module according to an embodiment of the present disclosure. FIG. 8 is a perspective view of a cross-section cut along line VIII-VIII' shown in FIG. 7. FIG. 9 is a diagram illustrating a flow of condensed water in the structure shown in FIG. 7.

Hereinafter, the structure of a dishwasher including a circulator and a heat exchanger according to the present embodiment will be described with reference to FIGS. 2 to 9.

The dishwasher 10 according to the present embodiment may further include: the circulator 100 which compresses warm and humid air in the tub 24 through heat exchange, heats the compressed air, and supplies the heated air to the inside of the tub 24; and a heat exchanger 200 which introduces external air to exchange heat with the circulator 100.

The circulator 100 according to the present embodiment circulates air in the tub 24. That is, the circulator 100 enables the air in the tub 24 to flow into a condensing module 110, a circulating fan module 140, and a heating module 150, and then supplied back to the inside of the tub 24. The circulator 100 circulates air in the tub 24 in a manner in which moisture contained in air discharged from the tub 24 is condensed through heat exchange with external air and then heated to supply hot and dry air to the tub 24. As such, as air in the tub 24 moves along the circulator 100, humid air is discharged and dry air is introduced, and accordingly, dishes placed in the tub 24 may be dried.

The circulator 100 according to the present embodiment includes: the condensing module 110 which condenses moisture contained in air discharged from the tub 24 through heat exchange with external air; the heating module 150 which heats the air having passed through the condensing module 110; and the circulating fan module 140 which operates so that air in the tub 24 passes through the condensing module 110 and the heating module 150 and then flows back to the inside of the tub 24.

The condensing module 110 according to the present embodiment perform heat exchange of air discharged from the tub 24 with external air flowing in the heat exchanger 200. In order to perform heat exchange between of the air discharged from the tub 24 with the external air, the condensing module 110 according to the present embodiment includes: a condensing chamber 112 which is spaced a predetermined distance apart from a side surface 28 of the tub 24; a flow path guide 114 and 116 which guides air flowing in the condensing chamber 112; and a condensed water guide 118 and 120 which guides a flow of a condensed water in the condensing chamber 112. The condensing module 110 according to the present embodiment may further include a condensing chamber connecting pipe 130 disposed on the tub 24 so as to connect the inside of the tub 24 and the condensing chamber 112.

The condensing chamber 112 according to the present embodiment may have the shape of a hollow plate. As having the sheet shape, the condensing chamber 112 according to the present embodiment may perform heat exchange with the heat exchange chamber 210 in a wide area. The condensing chamber 112 according to the present embodiment is disposed between the cabinet 20 and the tub 24. The condensing chamber 112 according to the present embodiment is disposed between the cabinet 20 and the heat exchange chamber 210 of the heat exchanger 200. The heat exchange chamber 210 in which external air flows is disposed on one side surface of the condensing chamber 112. A cabinet 20 defining the external appearance of the dishwasher 10 is disposed on the other side surface of the condensing chamber 112. The condensing chamber 112 according to the present embodiment contacts the heat exchanger 200 through one side surface, and contacts the cabinet through the other side surface.

Air flowing in the condensing chamber 112 may exchange heat with external air flowing in the heat exchange chamber 210 disposed on one side surface of the condensing chamber 112, such that hot and humid air may be condensed. In addition, the air flowing in the condensing chamber 112 may exchange heat with the outside of the dishwasher 10 through the cabinet 20 disposed on the other side surface of the condensing chamber 112. In this case, since the air flowing in the condensing chamber 112 exchanges heat through both side surfaces thereof, heat may be exchanged more effectively.

A condensed water discharge hole 166, through which condensed water is discharged, is formed in one lower side of the condensing chamber 112 according to the present embodiment. The condensed water discharge hole 166 according to the present embodiment enables the condensing chamber 112 and the heating module 150 to communicate with each other.

A condensed water discharge guide 164, which guides condensed water flowing along the condensed water guide 118 and 120 toward the condensed water discharge hole 166, is disposed in the condensing chamber 112 according to the present embodiment. The condensed water discharge guide 164 according to the present embodiment is disposed below the condensed water discharge hole 166, and guides condensed water to a circulator exhaust hole 82 which is formed on a side surface of the tub 24.

The condensing chamber 112 according to the present embodiment may include a first surface 126*a* forming a partition with respect to the heat exchanger 200, a second surface 126*b* disposed to oppose the cabinet 20, a front surface 127*a* connecting the first surface 126*a* and the second surface 126*b* at the front of the condensing chamber 112, and a rear surface 127*b* connecting the first surface 126*a* and the second surface 126*b* at the rear of the condensing chamber 112.

An upper part 128*a* of the condensing chamber 112 according to the present embodiment forms a wide extended surface in a rectangular shape, and a flow path guide may be disposed inside the upper part 128*a*. A lower part 128*b* of the condensing chamber 112 according to the present embodiment is disposed below the upper part 128*a* of the condensing chamber 112, and has a shape which decreases in area compared to the upper part 128*a*.

The upper part 128*a* of the condensing chamber 112 is connected to the condensing chamber connecting pipe 130 through which air is introduced from the tub 24 from above. The condensing chamber 112 according to the present embodiment is connected to the condensing chamber connecting pipe 130 at the rear of an upper surface. The flow path guide 114 and 116, which guides air flowing in the condensing chamber 112, is disposed in the upper part 128*a* of the condensing chamber 112. The condensed water discharge guide 164 of the condensing chamber 12 is formed in the lower part 128*b* of the condensing chamber 112. A condensing chamber exhaust part 124 connected to the circulating fan module 140 is disposed at the lower end of the lower part 128*b* of the condensing chamber 112.

A condensing flow path, along which air discharged from the tub 24 flows, is formed in the condensing chamber 112. The condensing flow path may be formed by the flow path guide 114 and 116 formed in the condensing chamber 112. A length of the condensing flow path may be adjusted by the flow path guide 114 and 116. The flow path guide 114 and 116 may be installed in consideration of a flow rate and a heat-exchanged degree of air.

The flow path guide 114 and 116 according to the present embodiment may include a first flow path guide 114 which changes a direction of air introduced through the condensing chamber connecting pipe 130, and a second flow path guide 116 which changes a direction of air flowing along the first flow path guide 114. The first flow path guide 114 and the second flow path guide 116 are connected with each other from the first surface 126*a* to the second surface 126*b* to adjust a direction of air flowing in the condensing chamber 112.

The first flow path guide 114 and the second flow path guide 116 are disposed in the upper part 128*a* of the condensing chamber 112. However, this is merely an example, and the first flow path guide 114 and the second flow path guide 116 may be installed even in the lower part 128*b* of the condensing chamber 112.

The first flow path guide 114 according to the present embodiment may be disposed below the condensing chamber connecting pipe 130, and the first flow path guide 114 may be inclined with respect to a direction of a flow path formed in the condensing chamber connecting pipe 130. The first flow path guide 114 according to the present embodiment extends forward from the rear surface 127*b*.

The second flow path guide 116 according to the present embodiment is disposed below the first flow path guide 114. Accordingly, condensed water fallen from the first flow path guide 114 may drop to the second flow path guide 116. The second flow path guide 116 may have a bent shape so that the air changes its direction to flow downward.

The second flow path guide 116 is disposed below an end portion of the first flow path guide 114. An inclined surface of the front surface 127*a* or the condensed water discharge guide 164 is disposed below an end portion of the second flow path guide 116. Accordingly, condensed water fallen from the second flow path guide 116 may drop to a first side cross-sectional surface or the condensed water discharge guide 164 and flow to the condensed water discharge hole 166.

The condensing chamber 112 discharges air, introduced from the top, to the bottom. The first flow path guide 114 and the second flow path guide 116 may change a direction of air flowing from top to bottom in the condensing chamber 112. Air introduced into the condensing chamber 112 from the condensing chamber connecting pipe 130 may flow forward by the first flow path guide 114 and flow backward by the second flow path guide 116. The first flow path guide 114 and the second flow path guide 116 maintain a flow rate of air flowing in the condensing chamber 112 within a predetermined range, and increase a heat-exchange area of air passing through the condensing chamber 112.

The first flow path guide 114 and the second flow path guide 116 may increase a length of distance which air flows in the condensing chamber 112, thereby increasing a condensing degree of hot and humid air discharged from the tub 24.

The condensed water guide 118 and 120, which guides movement of condensed water in air flowing in the condensing chamber 112, is formed in the condensing chamber 112.

The condensed water guide 118 and 120 according to the present embodiment is disposed below the flow path guide 114 and 116. The condensed water guide 118 and 120 guides condensed water, formed along an inner side surface of the condensing chamber 112, to flow toward the circulator exhaust hole 82 formed on a side surface of the tub 24. The condensed water guide 118 and 120 according to the present embodiment includes a first condensed water guide 118 formed on one inner surface of the condensing chamber 112, and a second condensed water guide 120 formed on the other side surface of the condensing chamber 112. The first condensed water guide 118 according to the present embodiment protrudes inward from the first surface 126*a*, and the second condensed water guide 120 protrudes inward from the second surface 126*b*. The condensed water guide 118 and 120 according to the present embodiment is formed to be inclined forward and downward.

The condensed water guide 118 and 120 according to the present embodiment is formed to be inclined downward from the rear surface 127*b* in a direction toward the front surface 127*a*. The condensed water guide 118 and 120 according to the present embodiment is disposed at a position higher than that of the condensed water discharge guide 164. The condensed water guide 118 and 120 according to the present embodiment is disposed at a position higher than that of the condensed water discharge hole 166.

A plurality of first condensed water guides 118 and a plurality of condensed water guides 120 may be disposed in the condensing chamber 112 according to the present embodiment. The plurality of first condensed water guides 118 and the plurality of second condensed water guides 120 according to the present embodiment may be disposed above the condensed water discharge guide 164.

The condensed water discharge guide 164 according to the present embodiment guides condensed water, generated in the condensing chamber 112, toward the circulator exhaust hole 82 formed on a side surface of the tub 24, so that the condensed water flows into the tub 24.

The condensing chamber connecting pipe 130 according to the present embodiment is connected to a circulator inflow hole 80 formed on the upper surface of the tub 24. The condensing chamber connecting pipe 130 according to the present embodiment delivers air in the tub 24 into the condensing chamber 112. The condensing chamber connecting pipe 130 according to the present embodiment is disposed on the tub 24.

The condensing chamber connecting pipe 130 according to the present embodiment is disposed on the tub 24 and makes the inside of the tub 24 and the condensing chamber 112 to communicate with each other. One end of the condensing chamber connecting pipe 130 is connected to the circulator inflow hole 80 disposed on the tub 24, and the other end of the condensing chamber connecting pipe 130 is connected to an upper rear portion of the condensing chamber 112.

The condensing chamber connecting pipe 130 according to the present embodiment has a sloped surface 132 at a portion extending upward from the circulator inflow hole 80 of the tub 24, the sloped surface 132 whose area increases upward. The condensing chamber connecting pipe 130 according to the present embodiment extends along the upper surface 29 of the tub 24 and is connected to the condensing chamber 112. The condensing chamber connecting pipe 130 extending along the upper surface 29 of the tub 24 may be formed downward in a direction toward the circulator inflow hole 80.

Due to the sloped surface 132 formed over the circulator inflow hole 80 of the condensing chamber connecting pipe 130 and the structure of the condensing chamber connecting pipe 130 inclined along the upper surface 29 of the tub 24, wash water sprayed by a spray nozzle toward the condensing chamber connecting pipe 130 in the tub 24 may flow into the circulator inflow hole 80 of the tub 24 again. Such a structure of the condensing chamber connecting pipe 130 may prevent wash water sprayed by the spray nozzle in the tub 24 from being introduced into the condensing chamber 112 of the condensing module 110.

<Heating Module>

The heating module 150 according to the present embodiment heats air having passed the condensing module 110. The heating module 150 according to the present embodiment heats flowing air and sends the heated air into the tub 24.

The heating module 150 according to the present embodiment may include a heater 152 which heats flowing air, and a hot air tube 154 which delivers the heated air into the tub 24. The heater according to the present embodiment is disposed at the entrance of the hot air tube 154.

An ascending flow path 156 formed to make air ascend, and a descending flow path 158 formed to make air flown from the ascending flow path descend are formed in the hot air tube 154 according to the present embodiment. A heater according to this embodiment is disposed below the ascending flow path 156 according to the present embodiment. The circulator exhaust hole 82 communicating with the tub 24 is formed at an end portion of the descending flow path 158. The hot air tube 154 according to the present embodiment includes a flexure 160 which connects the ascending flow path 156 and the descending flow path 158. The flexure 156 is disposed above the ascending flow path to guide air flowing in the ascending flow path 156 toward the descending flow path 158. Due to the descending flow path 158 and the flexure 160 of the heating module 150, wash water sprayed toward the circulator exhaust hole 82 in the tub 24 is prevented from flowing into the heater. An inflow end of the ascending flow path 156 according to the present embodiment may be disposed in front of the condensing chamber exhaust part 124.

<Circulating Fan Module>

The circulating fan module 140 according to the present embodiment suctions air in the tub 24 into the circulator inflow hole 80 to deliver the suctioned air to the circulator exhaust hole 82. The circulating fan module 140 according to the present embodiment enables air flowing in the condensing module 110 to flow into the heating module 150.

The circulating fan module 140 according to the present embodiment includes a circulating fan housing 144 which connects the condensing module 110 and the heating module 150, and a circulating fan 142 which is disposed in the circulating fan housing 144 and configured to enable air to flow. The circulating fan module 140 connects the condensing chamber exhaust part 124 of the condensing chamber 112 and the heating module 150, in which the ascending flow path 156 is formed.

<Heat Exchanger>

The heat exchanger 200 according to the present embodiment makes hot vapor in the tub 24 to exchange heat with external air. The heat exchanger 200 according to the present embodiment suctions external air, performs heat exchange of the external air with the circulator 100, and then discharges the heat-exchanged air to the outside.

The heat exchanger 200 according to the present embodiment includes: the heat exchange chamber 210 disposed between the tub 24 and the condensing chamber 112 of the condensing module 110 to exchange heat with the condensing module 110; an external air inflow part 220 disposed in front of the heat exchanger 210 and having an external air inlet 222 formed therein, through which external air is introduced; and an external air discharge part 230 through which air having passed the heat exchange chamber 210 is discharged to the outside.

The heat exchange chamber 210 according to the present embodiment is disposed between the tub 24 and the condensing chamber 112. Air introduced from the outside flows in the heat exchange chamber 210 to exchange heat with air flowing in the condensing chamber 112. In addition, air introduced from the outside may flow in the heat exchange chamber 210 to condense air flowing in the tub 24.

A heat exchange chamber inflow port 214, through which external air is introduced, is formed at the front of the heat exchange chamber 210 according to the present embodiment, and a heat exchange chamber discharge port, through which air is discharged, is formed at the bottom of the heat exchange chamber 210. The heat exchange chamber inflow port 214 according to the present embodiment may be formed at a position higher than that of the external air inlet 222 of the external air inflow part 220.

A heat exchange chamber-flow path guide 114 and 116, which guides air introduced from the front in a rearward and upward direction, is disposed in the heat exchange chamber 210 according to the present embodiment. External air introduced into the heat exchange chamber inflow port 214 by the heat exchange chamber-flow path guide 114 and 116 flows upward to be discharged to the heat exchange chamber discharge part 216 in which the heat exchange chamber discharge port is formed at the bottom. The heat exchange chamber discharge part 216 according to the present embodiment is disposed behind the condensing chamber exhaust part 124 of the condensing chamber 112.

The heat exchange chamber 210 according to the present embodiment may exchange heat with the condensing chamber 112 through one side surface of the heat exchange chamber 210 to condense air flowing in the condensing chamber 112. In addition, the heat exchange chamber 210 exchanges heat with air flowing in the tub 24 through the other side surface of the heat exchange chamber 210 to condense the air flowing in the tub 24, thereby removing humidity in the tub 24.

The external air inflow part 220 according to the present embodiment is disposed at the front of the heat exchange chamber 210. At the front of the heat exchange chamber 210, the external air inflow part 220 according to the present embodiment is longitudinally vertically disposed. The external air inflow part 220 according to the present embodiment introduces external air through the external air inlet 222 formed at a front lower portion of the dishwasher 10, and enables the introduced air to upwardly flow into the heat exchange chamber 210.

The external air discharge part 230 according to the present embodiment may be disposed below the tub 24. The external air discharge part 230 according to the present embodiment is connected to the heat exchange chamber discharge part 216. The external air discharge part 230 according to the present embodiment discharges air, discharged from the heat exchange chamber 210, to the outside of the cabinet 20.

The external air discharge part 230 according to the present embodiment may discharge air in a direction forward or rearward of the dishwasher 10. The external air discharge part 230 according to the present embodiment may include an exhaust fan 232 that enables air in the heat exchanger 200 to flow. The exhaust fan 232 according to the present embodiment is disposed below the tub 24.

The exhaust fan 232 according to the present embodiment may be connected to the circulating fan 142. Along with the circulating fan 142, the exhaust fan 232 according to the present embodiment may be configured as a may be configured as dual shaft fans installed to one motor. In this case, the exhaust fan 232 and the circulating fan 142 may be disposed on the same rotational shaft. Accordingly, the exhaust fan 232 and the circulating fan 142 operate by one motor, thereby introducing external air and circulating air in the tub 24.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternatives uses will also be apparent to those skilled in the art.

What is claimed is:

1. A dishwasher, comprising:

a cabinet that defines an external appearance of the dishwasher;

a tub that is located in the cabinet and that defines a wash space configured to receive one or more objects to be washed;

a heat exchanger that is located between the tub and the cabinet and that defines a heat-exchange space configured to allow external air to flow therein; and a condensing module that is located between the heat exchanger and the cabinet, that is configured to exchange heat between air discharged from the tub and external air flowing in the heat exchanger, and that is configured to discharge heat-exchanged air to flow into the tub, wherein the condensing module comprises:

a condensing chamber that is located between the cabinet and the heat exchanger and that defines a condensing space configured to receive air discharged from the tub, the condensing chamber having a first surface in contact with the heat exchanger, and a second surface in contact with the cabinet, and a condensing chamber connecting pipe that is located at the tub and that connects an inside of the tub to the condensing chamber, and wherein the heat exchanger comprises:

a heat exchange chamber that is located between the condensing module and the tub and that defines the heat-exchange space, the heat exchange chamber having a first side surface in contact with the tub and a second side surface in contact with the first surface of the condensing module, an external air inflow part that is located forward of the heat exchange chamber and that has a front surface that defines an external air inlet configured to introduce external air to the heat exchanger, and an external air discharge part comprising an exhaust fan configured to cause external air flowing in the heat exchange chamber to be discharged to an outside of the cabinet.

2. The dishwasher of claim 1, further comprising a heating module configured to supply heat to air flowing through the condensing module and guide heated air to the inside of the tub.

3. The dishwasher of claim 2, wherein the heating module comprises:

a heater configured to supply heat to air flowing through the condensing module; and a hot air tube configured to guide air heated by the heater to the inside of the tub.

4. The dishwasher of claim 3, wherein the hot air tube defines:

an ascending flow path configured to guide heated air in an upward direction; and a descending flow path that is configured to receive air from the ascending flow path, that is configured to guide air from the ascending flow path in a downward direction toward the tub, and wherein the heater is located vertically below the ascending flow path.

5. The dishwasher of claim 1, further comprising a circulating fan module configured to move air in the tub to pass through the condensing module and then return into the tub.

6. The dishwasher of claim 1, wherein the condensing chamber comprises:

a first flow path guide located in the condensing chamber and configured to guide air flowing in the condensing chamber; and a condensed water guide that is located in the condensing chamber, that is located vertically below the first flow path guide, and that is configured to guide condensed water generated in the condensing chamber.

7. The dishwasher of claim 6, wherein the tub defines a condensed water discharge hole that is located vertically below the condensed water guide and that is configured to discharge condensed water generated in the condensing chamber to the inside of the tub, and wherein the tub comprises a condensed water discharge guide configured to guide condensed water flowing along the condensed water guide toward the condensed water discharge hole.

8. The dishwasher of claim 7, wherein the tub defines:

a circulator inflow hole located at an upper surface of the tub and configured to supply air from the tub to the condensing module;

a circulator exhaust hole located at a side surface of the tub and configured to discharge air flowing in the condensing module to the inside of the tub, and wherein the condensed water discharge guide is configured to guide condensed water generated in the condensing chamber to the circulator exhaust hole.

9. The dishwasher of claim 8, wherein the condensing chamber connecting pipe is connected to the circulator inflow hole and located at the upper surface of the tub, the condensing chamber connecting pipe being configured to guide air from the tub to the condensing module, and wherein the condensing chamber connecting pipe has a sloped surface that is inclined with respect to the upper surface of the tub and that extends upward from the circulator inflow hole, a cross-sectional area of the condensing chamber connecting pipe increasing in an upward direction from the circulator inflow hole.

10. The dishwasher of claim 1, wherein the external air inlet is defined at a lower portion of the front surface of the external air inflow part.

11. The dishwasher of claim 1, wherein the heat exchanger comprises a second flow path guide configured to guide external air introduced from the external air inlet in a rearward and upward direction.

12. A dishwasher, comprising:

a cabinet that defines an external appearance of the dishwasher;

a tub that is located in the cabinet and that defines a wash space configured to receive one or more objects to be washed;

a heat exchanger that is located between the tub and the cabinet and that defines a heat-exchange space configured to allow air introduced from an outside of the cabinet to flow therein; and a circulator that is located at a side of the heat exchanger, that is configured to condense air discharged from the tub through heat exchange with the heat exchanger, and that is configured to heat air discharged from the tub and return heated air into the tub, wherein the circulator comprises a condensing module that is located between the heat exchanger and the cabinet, that is configured to exchange heat between air discharged from the tub and external air flowing in the heat exchanger, and that is configured to discharge heat-exchanged air to flow into the tub, wherein the condensing module comprises:

a condensing chamber that is located between the cabinet and the heat exchanger and that defines a condensing space configured to receive air discharged from the tub, the condensing chamber having a first surface in contact with the heat exchanger, and a second surface in contact with the cabinet, and a condensing chamber connecting pipe that is located at the tub and that connects an inside of the tub to the condensing chamber, and wherein the heat exchanger comprises:

a heat exchange chamber that is located between the condensing module and the tub and that defines the heat-exchange space, the heat exchange chamber having a first side surface in contact with the tub and a second side surface in contact with the first surface of the condensing module, an external air inflow part that is located forward of the heat exchange chamber and that has a front surface that defines an external air inlet configured to introduce external air to the heat exchanger, and an external air discharge part comprising an exhaust fan configured to cause external air flowing in the heat exchange chamber to be discharged to the outside of the cabinet.

13. The dishwasher of claim 12, wherein the cabinet and the tub are spaced apart from each other and define a side space that accommodates the heat exchanger and the circulator between an inner surface of the cabinet and an outer surface of the tub.

14. The dishwasher of claim 12, further comprising a heating module configured to supply heat to air flowing through the circulator and guide heated air into the tub.

15. The dishwasher of claim 14, wherein the heating module comprises:

a heater configured to supply heat to air flowing through the circulator; and a hot air tube configured to guide air heated by the heater to the inside of the tub.

16. The dishwasher of claim 15, wherein the tub comprises:

an upper surface that defines a circulator inflow hole configured to supply air from the tub to the circulator; and a side surface that defines a circulator exhaust hole configured to receive heated air from the circulator.

17. The dishwasher of claim 16, wherein the heater is located vertically below the circulator exhaust hole.

18. The dishwasher of claim 1, wherein the condensing module comprises a partition that is disposed between the condensing chamber and the heat exchange chamber and extends downward along a side surface of the tub, and wherein opposite surfaces of the partition define the first surface of the condensing chamber and the second side surface of the heat exchange chamber, respectively.

19. The dishwasher of claim 18, wherein the partition further extends in a front-rear direction of the cabinet, and wherein the condensing module further comprises:

a front surface that connects front sides of the first and second surfaces of the condensing chamber to each other; and a rear surface that connects rear sides of the first and second surfaces of the condensing chamber to each other.

20. A dishwasher, comprising:

a cabinet that defines an external appearance of the dishwasher;

a tub that is located in the cabinet and that defines a wash space configured to receive one or more objects to be washed;

a heat exchanger that is located between the tub and the cabinet and that defines a heat-exchange space configured to allow external air to flow therein; and a condensing module that is located between the heat exchanger and the cabinet, that is configured to exchange heat between air discharged from the tub and external air flowing in the heat exchanger, and that is configured to discharge heat-exchanged air to flow into the tub, wherein the heat exchanger has a first side configured to exchange heat with internal air inside the tub, and a second side configured to exchange heat with internal air inside the condensing module, wherein the condensing module has a first surface configured to exchange heat with internal air inside the heat exchanger, and a second surface in surface contact with the cabinet, wherein the condensing module comprises:

a condensing chamber that is located between the cabinet and the heat exchanger and that defines a condensing space configured to allow air discharged from the tub to flow therein, and a condensing chamber connecting pipe that is located at the tub and that connects an inside of the tub to the condensing chamber, wherein the condensing chamber comprises:

a first flow path guide located in the condensing chamber and configured to guide air flowing in the condensing chamber, and a condensed water guide that is located in the condensing chamber, that is located vertically below the first flow path guide, and that is configured to guide condensed water generated in the condensing chamber, wherein the tub defines a condensed water discharge hole that is located vertically below the condensed water guide and that is configured to discharge condensed water generated in the condensing chamber to an inside of the tub, and wherein the tub comprises a condensed water discharge guide configured to guide condensed water flowing along the condensed water guide toward the condensed water discharge hole.

* * * * *